US007866244B2

(12) United States Patent
Asahina et al.

(10) Patent No.: US 7,866,244 B2
(45) Date of Patent: Jan. 11, 2011

(54) BLASTING TREATMENT APPARATUS

(75) Inventors: Kiyoshi Asahina, Kobe (JP); Ryusuke Kitamura, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 12/227,165

(22) PCT Filed: Apr. 20, 2007

(86) PCT No.: PCT/JP2007/058599

§ 371 (c)(1),
(2), (4) Date: Nov. 10, 2008

(87) PCT Pub. No.: WO2007/132634

PCT Pub. Date: Nov. 22, 2007

(65) Prior Publication Data

US 2009/0229451 A1 Sep. 17, 2009

(30) Foreign Application Priority Data

May 11, 2006 (JP) ..... 2006-132685

(51) Int. Cl.
*F42B 33/00* (2006.01)

(52) U.S. Cl. ..... 86/50; 588/299; 206/317; 110/237

(58) Field of Classification Search ..... 86/50; 588/202, 299; 206/317; 110/237
See application file for complete search history.

(56) References Cited

U.S. PATENT DOCUMENTS 5,419,862 A * 5/1995 Hampel ..... 264/84
5,574,203 A * 11/1996 Noel et al. ..... 588/299
5,864,767 A * 1/1999 Drumgoole et al. ..... 588/313
5,959,193 A * 9/1999 Rubitschung et al. ..... 73/35.17
6,173,662 B1 * 1/2001 Donovan ..... 110/237

(Continued)

FOREIGN PATENT DOCUMENTS

CA 2 381 651 A1 4/2002

(Continued)

*Primary Examiner*—J. Woodrow Eldred
*Assistant Examiner*—Gabriel J Klein
(74) *Attorney, Agent, or Firm*—Stites & Harbison, PLLC; Juan Carlos A. Marquez, Esq

(57) ABSTRACT

It is intended to provide a blasting treatment apparatus which can prevent dispersion of a hazardous substance or the like to the exterior with a simple structure. To achieve this object, a blasting treatment apparatus (1) comprises a pressure container (10) including an outer vessel (31) and an inner vessel (32) and a suction device. The outer vessel (32) has a first sucking part (17) and a second sucking part (18) for interconnecting the interior and the exterior of the outer vessel (31) at an end thereof opposite to a pressure-resistant lid (11) and in an upper wall. The inner vessel (32) has an interconnect hole (16) for interconnecting the interior and the exterior of the inner vessel (32) at a location thereof corresponding to the first sucking part (17). The first sucking part (17) and the second sucking part (18) are located at positions where gas in the inner vessel (32) can be sucked by the suction device and the gas released from the inner vessel (32) through an inner opening (32*a*) can be sucked from a gap between the upper wall of the outer vessel (31) and the inner vessel (32).

4 Claims, 3 Drawing Sheets

U.S. PATENT DOCUMENTS

| | | | | |
|---|---|---|---|---|
| 6,354,181 | B1 * | 3/2002 | Donovan | 86/50 |
| 6,470,783 | B2 * | 10/2002 | Ito et al. | 86/50 |
| 7,073,424 | B2 | 7/2006 | Ferrari et al. | |
| 7,418,895 | B2 * | 9/2008 | Donovan et al. | 86/50 |
| 2004/0107824 | A1 | 6/2004 | Ferrari et al. | |
| 2007/0144637 | A1 | 6/2007 | Fujiwara et al. | |

FOREIGN PATENT DOCUMENTS

| | | |
|---|---|---|
| JP | 7-128000 | 11/1993 |
| JP | 7-286886 | 4/1994 |
| JP | 2004-531685 | 5/2002 |
| JP | 2004-321910 | 4/2003 |
| JP | 2005-207623 | 1/2004 |
| JP | 2005-214553 | 1/2004 |
| WO | WO 2005/075934 A1 | 1/2005 |

* cited by examiner

BLASTING TREATMENT APPARATUS

TECHNICAL FIELD

The present invention relates to a blasting treatment apparatus for preventing dispersion of a chemical agent or a hazardous substance to the exterior when an explosive object containing the chemical agent or the hazardous substance is disposed of by blasting operation.

BACKGROUND ART

Known among military ammunition used as chemical weapons or the like (such as projectiles, bombs, land mines and naval mines) is a device with a steel bomb shell whose internal space is filled with a bursting charge and a chemical agent hazardous to human bodies. Mustard gas and lewisite hazardous to human bodies are examples of such chemical agents.

A known method of disposing of (e.g., detoxifying) the aforementioned chemical weapons and hazardous substances such as organic halogen or the like is blasting disposal operation. The blasting disposal method does not require disassembling operation. Therefore, this blasting disposal method is applicable not only to disposal of a favorably preserved chemical weapon or the like but also to disposal of a chemical weapon or the like which has become difficult to disassemble due to deterioration over time or deformation. Furthermore, the blasting disposal operation produces ultrahigh temperature and ultrahigh pressure in a surrounding area of the chemical weapon or the like, so that almost all of the chemical agents can be decomposed by use of the blasting disposal method. This kind of blasting disposal method is disclosed in Patent Document 1, for example.

In the blasting disposal method, the chemical weapons or the like are often disposed of in a sealed pressure container. This approach is used to prevent leakage of the chemical agents to the exterior and to reduce propagation of noise and vibration to the exterior. Typically, the pressure container is provided with a lid which can be opened and closed. The chemical weapon or the like is placed inside the pressure container with the lid open. Then, the lid is closed and the chemical weapon or the like is subjected to the blasting disposal operation under conditions where an internal space of the pressure container is sealed. After the blasting operation, the lid is reopened and the interior of the pressure container is cleaned. Upon completion of the blasting operation, however, there remain hazardous gases like carbon monoxide produced by detonation and the hazardous substance within the pressure container. Accordingly, when the lid is opened for cleaning and so on, it is necessary to ensure that the aforementioned hazardous substance or the like would not disperse to the exterior from inside the pressure container. One approach to suppressing such dispersion of the hazardous substance or the like is to provide a suction device on an opposite side of the lid and introduce atmospheric air into the pressure container from the exterior at a constant rate by the suction device, for example.

Patent Document 1: Japanese Unexamined Patent Publication No. 7-286886

DISCLOSURE OF THE INVENTION

The pressure container used in the aforementioned application is a sturdy container capable of withstanding blasting sound and impact produced at the time of detonation. However, damages to the pressure container caused by the impact produced at the time of detonation and scattering fragments of an object to be treated are not so little. This causes such damages as scratches and dents or the like in the container after a small number of blasting operations, making it necessary to replace the pressure container in a relatively early stage. Furthermore, the pressure container used for the blasting disposal operation is so large in size and weight that replacement of the pressure container entails considerable labor and cost.

On the other hand, there are cases where a large-sized pressure container must be used depending on the type and size of the object to be treated. In such a case, it is necessary to also increase the size of the suction device to ensure a sufficient amount of sucking force produced thereby, which results in a further increase in cost.

Accordingly, it is an object of the invention to provide a blasting treatment apparatus which can prevent dispersion of a hazardous substance to the exterior with a simple structure.

The present invention provides a blasting treatment apparatus for achieving the aforementioned object, which is a blasting treatment apparatus for disposing of an object to be treated by blasting operation, the blasting treatment apparatus comprising a pressure container in which the blasting operation is performed, and a suction device connected to the pressure container for sucking gas within the pressure container to the exterior. The pressure container has a shape extending in a specific direction and includes a sealable outer vessel and an inner vessel disposed inside the outer vessel. The inner vessel includes an inner opening formed in one of two ends of the inner vessel, an inner lid for opening and closing the inner opening, and an interconnect hole formed in the end of the inner vessel opposite to the inner lid for interconnecting the interior and the exterior of the inner vessel. The outer vessel includes an outer opening formed in an end of the outer vessel on the same side as the inner lid, a pressure-resistant lid for opening and closing the outer opening, a first sucking part provided at a location corresponding to the interconnect hole of the inner vessel for interconnecting the interior and the exterior of the outer vessel, and a second sucking part provided in an upper wall of the outer vessel between the first sucking part and the pressure-resistant lid for interconnecting the interior and the exterior of the outer vessel, the outer vessel having a shape appropriate for sealing an internal space of the outer vessel with the pressure-resistant lid closed. The first sucking part and the second sucking part are located so that gas produced in the inner vessel as a result of blasting therein is sucked from the first sucking part through the interconnect hole in the inner vessel and the gas produced as a result of blasting and released from the inner vessel through the inner opening when the inner lid is opened is sucked from a gap between the upper wall of the outer vessel and the inner vessel in state that the suction device is connected to the two sucking parts.

According to this configuration, it is possible to receive an impact or the like produced at the time of blasting with the inner vessel so that damages to the outer vessel can be reduced. Therefore, it is not necessary to replace the thick-walled outer vessel and the blasting operation can be recommenced by replacing the inner vessel alone. This makes it possible to reduce running cost and labor required for replacement.

BEST MODE FOR CARRYING OUT THE INVENTION

A blasting treatment apparatus according to an embodiment of the present invention is described below with reference to the drawings.

First, an explosive object to be disposed of by blasting operation by using the blasting treatment apparatus of the present embodiment is described. As an example of the explosive object, a chemical bomb which is a chemical weapon is explained with reference to FIG. 3, which is a cross-sectional diagram generally showing the construction of the chemical bomb.

Figure 3:
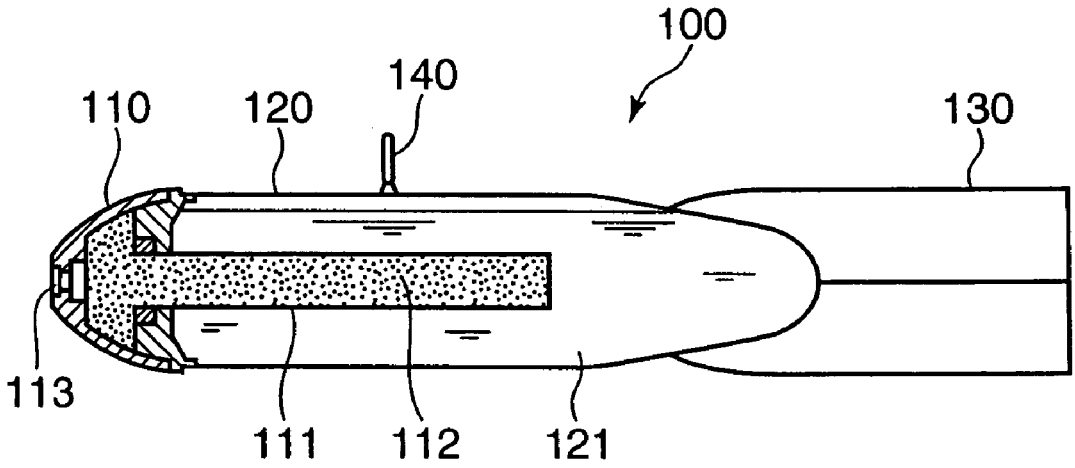
FIG. 3 is a cross-sectional diagram showing an example of a chemical bomb disposed of in the pressure container according to the present invention.

The chemical bomb (explosive object) 100 shown in FIG. 3 has a nose 110, a burster tube 111, a bomb shell 120 and attitude-controlling fins 130.

The burster tube 111 is shaped to extend rearward from the nose 110. The burster tube 111 contains a bursting charge (explosive) 112. The nose 110 is provided a fuze 113 for detonating the bursting charge 112.

The bomb shell 120 is connected to the nose 110, the bomb shell 120 accommodating therein the burster tube 111. An internal space of the bomb shell 120 is filled with a liquid chemical agent (hazardous substance) 121. The attitude-controlling fins 130 are located at an end of the bomb shell 120 opposite to the nose 110 in an axial direction of the bomb shell 120. These attitude-controlling fins 130 serve to control the attitude of the chemical bomb 100 when the chemical bomb 100 is dropped.

Attached to an upper part of the bomb shell 120 is a hoist ring 140 used for suspending the chemical bomb 100. The chemical bomb 100 is hoisted by means of the hoist ring 140 and is subsequently loaded on an airplane or the like.

The explosive object to be disposed of in the present embodiment is the entirety or part of chemical bomb 100 containing the bursting charge 112 and the chemical agent 121 as described above. The present invention is not limited to disposal of the chemical bomb 100 filled with the chemical agent 121 as mentioned above but is also applicable to disposal of the burster tube 111 alone after disassembly of the chemical bomb 100.

The present invention is applicable to blasting disposal of such military explosives as TNT, picric acid and RDX, for instance. The present invention is also applicable to blasting disposal of blister agents like mustard and lewisite, vomiting agents like DC and DA, as well as such chemical agents as phosgene, sarin and hydrocyanic acid.

Furthermore, the blasting treatment apparatus of the present embodiment is usable not only for blasting disposal of the chemical bomb 100 cited above but also for blasting disposal of such a hazardous substance as organic halogen stored in a container, for example.

Next, the blasting treatment apparatus for disposing of an explosive object like the aforementioned chemical bomb 100 by the blasting operation is described with reference to FIG. 1, which is a schematic diagram generally showing the configuration of the blasting treatment apparatus.

Figure 1:
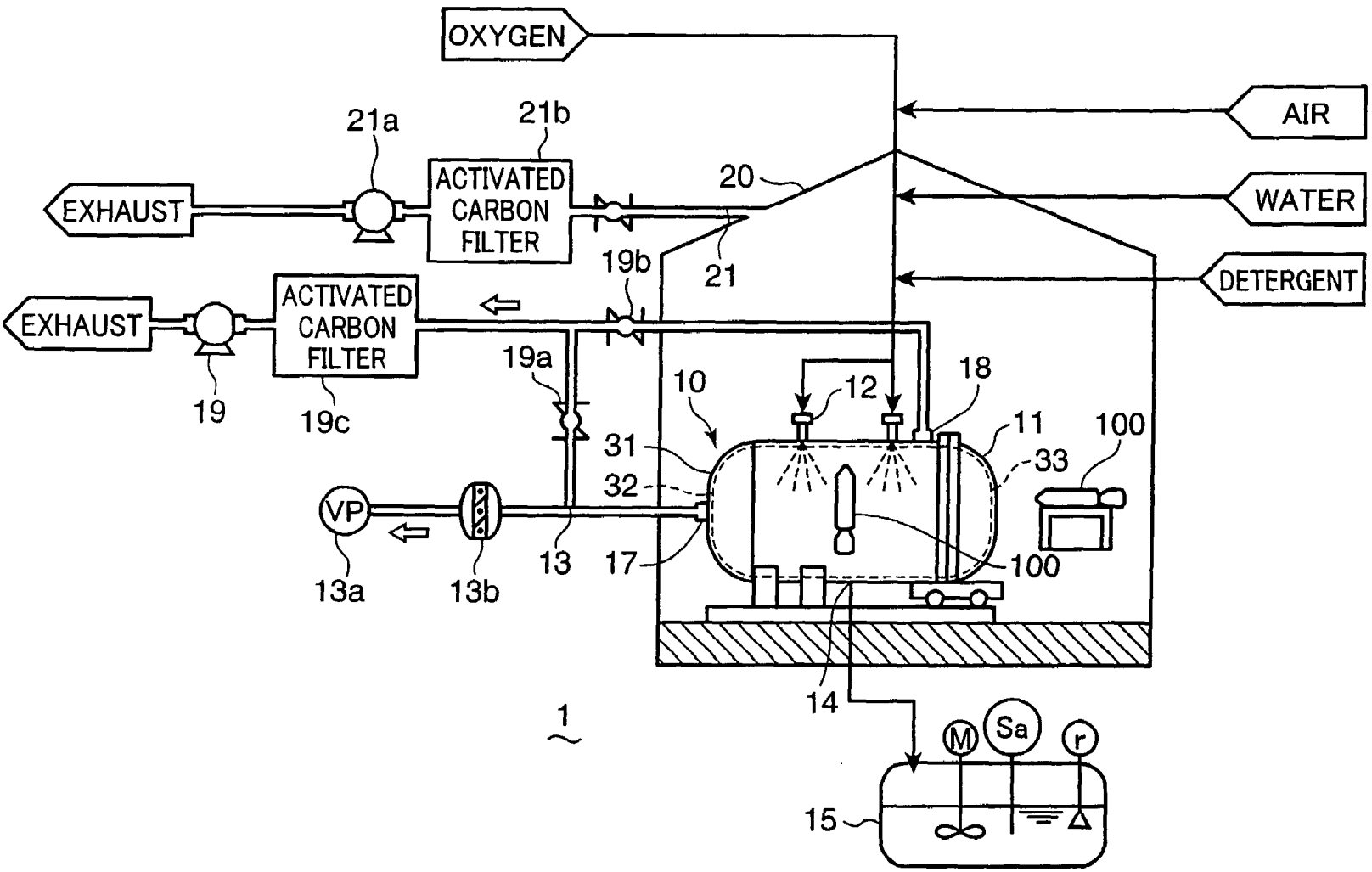
FIG. 1 is a diagram showing an overall configuration of a blasting treatment apparatus according to the present invention.

The blasting treatment apparatus 1 shown in FIG. 1 includes as principal constituent elements thereof a pressure container 10 and various kinds of exhaust devices. The blasting treatment apparatus 1 is accommodated in a tent 20.

Constructed of steel or the like, the pressure container 10 has an explosion-proof structure. Specifically, the pressure container 10 is made rigid enough to have strength to withstand a detonation pressure produced when an explosive object like the chemical bomb 100 is disposed of by the blasting operation inside the pressure container 10. Also, the pressure container 10 is constructed so rigidly that hazardous substances or the like produced by the blasting operation would not leak to the exterior.

The structure of the pressure container 10 is now described in detail with reference to FIG. 2, which is a cross-sectional diagram generally showing the structure of the pressure container 10.

Figure 2:
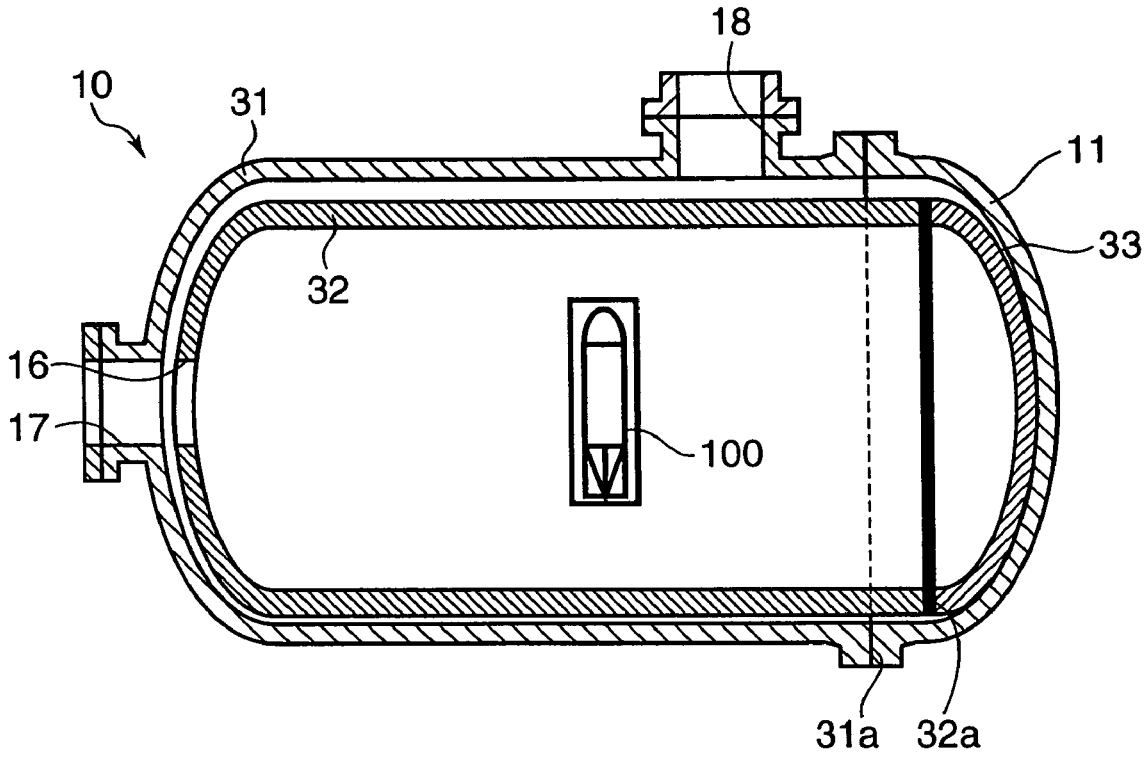
FIG. 2 is a general cross-sectional diagram of a pressure container according to the present invention.

As shown in FIG. 2, the pressure container 10 has a double-layered structure including an outer vessel 31 and an inner vessel 32.

The outer vessel 31 is a strong pressure-resistant receptacle made of steel or the like. The outer vessel 31 has a sufficient strength to bear an impact produced at the time of detonation. The outer vessel 31 also has such stiffness that is high enough to prevent outward leakage of hazardous substances or the like internally produced during the blasting operation. The outer vessel 31 has a cylindrical shape with an outer opening 31*a* formed in one end in a longitudinal direction of the outer vessel 31. The outer vessel 31 also has a pressure-resistant lid 11 which can open and close the outer opening 31*a*. The pressure-resistant lid 11 is attachable and removable to and from a main body portion of the outer vessel 31. The outer vessel 31 is sealed off when the pressure-resistant lid 11 is closed.

Additionally, in a portion of the outer vessel 31 opposite to the end thereof in which the aforementioned outer opening 31*a* is formed, there is formed a first sucking part 17 for interconnecting the interior and the exterior of the outer vessel 31. Further, in an upper wall of the outer vessel 31, there is formed a second sucking part 18 for interconnecting the interior and the exterior of the outer vessel 31. The second sucking part 18 is formed at a location closer to the outer opening 31*a* between the first sucking part 17 and the outer opening 31*a*.

The first sucking part 17 is connected to a vacuum pump 13*a* or to a later-described suction device as a result of manipulation of a directional control valve 13. Specifically, the first sucking part 17 is connected to the vacuum pump 13*a* through a filter 13*b* prior to the blasting operation. Then, the vacuum pump 13*a* discharges air from inside the pressure container 10 through the first sucking part 17, whereby an internal space of the pressure container 10 is brought into a decompressed or vacuum state.

After the blasting operation, on the other hand, the first sucking part 17 is connected to the aforementioned suction device. Then, the suction device sucks and discharges gases containing hazardous substances and such dust and dirt as debris of the bomb shell from inside the pressure container 10 through the first sucking part 17. At this point, the second sucking part 18 is connected to the suction device, so that the suction device sucks and discharges the gases and other materials from inside the pressure container 10 also through the second sucking part 18.

Like the above-described outer vessel 31, the inner vessel 32 has a cylindrical shape. The inner vessel 32 is manufactured with such a rigid material as steel or the like so that the inner vessel 32 can bear an impact load produced therein at the time of detonation and withstand collisions with flying fragments of the bomb shell. There is formed an inner opening 32*a* in one end in a longitudinal direction of the inner vessel 32. The inner vessel 32 is provided with an inner lid 33 which can open and close the inner opening 32*a*. The inner lid 33 is attachable and removable to and from a main body portion of the inner vessel 32. The inner lid 33 is provided on a side corresponding to the aforementioned pressure-resistant lid 11. Additionally, in an end of the inner vessel 32 opposite to the end thereof in which the aforementioned inner opening 32*a* is formed, there is formed an interconnect hole 16 for interconnecting the interior and the exterior of the inner vessel 32. The interconnect hole 16 is formed at a location corresponding to the aforementioned first sucking part 17.

The inner vessel 32 is not tightly affixed to the outer vessel 31. Specifically, the inner vessel 32 is loosely mounted so that the inner vessel 32 can be slightly displaced relative to the outer vessel 31. In addition, the inner vessel 32 is placed on a bottom wall of the outer vessel 31 in such a manner that a gap created between the inner vessel 32 and the outer vessel 31 becomes larger toward an upper side.

In an upper part of the pressure container 10 thus configured with the outer vessel 31 and the inner vessel 32, there are provided a plurality of injection ports 12. These injection ports 12 are used for injecting oxygen into the pressure container 10 prior to the blasting operation and for injecting air, water and detergent, for instance, into the pressure container 10 when carrying out a decontamination process after the blasting operation.

There is provided a drainage port 14 in a bottom part of the pressure container 10. The drainage port 14 is for discharging liquid waste or the like from inside the pressure container 10 into a treatment tank 15. This means that the liquid waste is discharged into the treatment tank 15 through the drainage port 14 after the decontamination process.

On the outside of the pressure container 10, there is provided an unillustrated ignition device. The ignition device is for igniting the explosive object like the chemical bomb 100 affixed inside the pressure container 10. The ignition device is so configured as to permit remotely-controlled execution of the blasting operation.

The suction device is connected to the pressure container 10 as mentioned earlier. The suction device which serves to suck gases or the like from inside the pressure container has a suction pump 19, a first regulating valve (first regulator) 19*a*, a suction pump 19 and a second regulating valve (second regulator) 19*b*. The first regulating valve 19*a* is provided between the suction pump 19 and the first sucking part 17 while the second regulating valve 19*b* is provided between the suction pump 19 and the second sucking part 18. There is further provided an activated carbon filter 19*c* for decontaminating the aforementioned gases between the individual regulating valves 19*a*, 19*b* and the suction pump 19. The first regulating valve 19*a* and the second regulating valve 19*b* are configured in such a manner that a balance between suction forces produced by the suction pump 19 at the first sucking part 17 and the second sucking part 18 can be adjusted by operating these regulating valves 19*a*, 19*b*.

A strong wall surrounding the pressure container 10 should preferably be formed so that the tent 20 will be protected even if the explosive object like the chemical bomb 100 destroys by any chance the pressure container 10.

The tent 20 has an unillustrated door. The pressure container 10 and the explosive object like the chemical bomb 100 are carried into the tent 20 with this door opened. The tent 20 is provided also with an exhaust vent 21 which is connected to a blower 21*a* for ventilating the interior of the tent 20 through a filter 21*b* containing activated carbon, for example.

Next, a method of disposing of the chemical bomb 100 by the blasting operation performed by using the blasting treatment apparatus 1 is described.

The chemical bomb 100 is carried into the tent 20 and placed within the inner vessel 32. Then, the inner lid 33 and the pressure-resistant lid 11 are closed to seal off the internal space of the pressure container 10. At this point, the directional control valve 13 is so adjusted that the first sucking part 17 and the vacuum pump 13*a* are connected to each other. Next, the air in the pressure container 10 is discharged by the vacuum pump 13*a* through the first sucking part 17 and the filter 13*b*, whereby the internal space of the pressure container 10 is brought into a decompressed or vacuum state. Subsequently, the chemical bomb 100 is blasted by the unillustrated ignition device.

Upon completion of blasting disposal of the chemical bomb 100, air, water and detergent, for instance, are injected into the pressure container 10 through the injection ports 12. The liquid waste in the pressure container 10 is discharged into the treatment tank 15 through the drainage port 14. Next, the first sucking part 17 and the suction pump 19 are interconnected by operating the directional control valve 13. Then, while gases containing hazardous substances are sucked and discharged from inside the pressure container 10 through the first sucking part 17 and the second sucking part 18 with the suction pump 19 activated, the inner lid 33 and the pressure-resistant lid 11 are opened. Subsequently, the internal space of the pressure container 10 now opening to the exterior is cleaned and preparatory work or the like for a subsequent blasting operation is performed.

The blasting operation produces an impact load by detonation and causes metal fragments of the bomb shell or the like of the chemical bomb 100 to scatter at high speed. Since the pressure container 10 has the double-layered structure including the outer vessel 31 and the inner vessel 32 as mentioned above, however, the impact load and the scattered fragments or the like are received by the inner vessel 32, causing almost no damage to the outer vessel 31. It is therefore possible to recommence the blasting operation by replacing the inner vessel 32 alone.

The gases containing hazardous substances fill up not only the interior of the inner vessel 32 but also the gap created between the outer vessel 31 and the inner vessel 32, flowing thereinto from the interior of the inner vessel 32 through the interconnect hole 16. However, because the first sucking part 17 connects to the interior of the inner vessel 32 as well as to the aforementioned gap through the interconnect hole 16, it is possible to suck through the first sucking part 17 the gases containing hazardous substances filled in the gap by means of the suction pump 19.

On the other hand, gases present at a location where the suction force produced at the first sucking part 17 is so difficult to reach that the gases can hardly be sucked through the first sucking part 17 tend to disperse to the exterior through the inner opening 32*a* when the openings 31*a*, 32*a* of the inner vessel 32 and the outer vessel 31 are opened by opening the inner lid 33 and the pressure-resistant lid 11. However, there is provided the second sucking part 18 connected to the suction pump 19 in the upper wall of the outer vessel 31. Thus, with the aid of the suction force produced at the second sucking part 18, it is possible to suck these gases into the gap between the outer vessel 31 and the inner vessel 32 and recover the gases to the exterior of the container through the second sucking part 18.

In particular, since an upward gas flow occurs around the openings 31*a*, 32*a* due to a temperature difference between the high-temperature gases in the inner vessel 32 and atmospheric air in the exterior, it is possible to efficiently suck the gases if the second sucking part 18 is provided in the upper wall of the outer vessel 31 as mentioned above. In addition, even if the gases discharged into the outer vessel 31 through the interconnect hole 16 flow to the aforementioned openings, the gases can be sucked through the second sucking part 18. This makes it possible to prevent dispersion of the gases containing hazardous substances to the exterior in a reliable fashion.

As thus far described, the pressure container 10 of the present embodiment is provided with the inner vessel 32 which protects the outer vessel 31 by receiving the impact load occurring at the time of detonation as well as the bomb shell or the like in addition to the outer vessel 31 having the strength to bear a pressure produced at the time of detonation, so that damages to the outer vessel 31 are reduced. Therefore, it is not necessary to replace the entirety of the pressure container 10 including the thick-walled outer vessel 31 which is required to have a rigid structure and the blasting operation can be recommenced by replacing the inner vessel 32 alone. This means that, compared to the conventional pressure container, the blasting treatment apparatus 1 reduces running cost thereof and labor.

Also, in the aforementioned blasting treatment apparatus 1, gases in the inner vessel 32 and gases discharged from the inner vessel 32 into the outer vessel 31 through the interconnect hole 16 are sucked through the first sucking part 17 and the gases which tend to disperse to the exterior through the inner opening 32*a* in the inner vessel 32 are sucked through the second sucking part 18. Therefore, the blasting treatment apparatus 1 prevents dispersion of the gases containing hazardous substances to the exterior in a more reliable fashion.

Furthermore, in the aforementioned blasting treatment apparatus 1, the first regulating valve 19*a* and the second regulating valve 19*b* provided respectively between the first sucking part 17 and the suction pump 19 and between the second sucking part 18 and the suction pump 19 balance the amounts of gases sucked through the individual sucking parts 17, 18. Therefore, the blasting treatment apparatus 1 efficiently prevents dispersion of the gases containing hazardous substances to the exterior.

In addition, according to the blasting treatment apparatus 1 which is so configured that the gap created between the inner vessel 32 and the outer vessel 31 becomes larger toward the upper side, the gases containing hazardous substances are efficiently sucked through the aforementioned second sucking part because the gases are introduced into this gap.

The present invention also embraces an arrangement in which the inner vessel 32 is tightly affixed to the outer vessel 31. However, if the inner vessel 32 is loosely fitted on the outer vessel 31 as previously mentioned, an impact produced at the time of detonation is unlikely to be directly transmitted to the outer vessel 31 and, as a consequence, an excessive force would not be applied to a joint portion between the inner vessel 32 and the outer vessel 31. Hence, this joint portion is less likely to be damaged, thus improving durability of the pressure container 10.

The present invention also embraces an arrangement in which the pressure container 10 containing an explosive object sealed therein is placed underground and disposed of by underground blasting operation.

The invention claimed is:

1. A blasting treatment apparatus for disposing of an object to be treated by a blasting operation, said blasting treatment apparatus comprising:

a pressure container in which the blasting operation is performed; and a suction device connected to said pressure container for sucking gas within said pressure container to the exterior;

said pressure container having a shape extending in a specific direction and including a sealable outer vessel and an inner vessel disposed inside the outer vessel;

said inner vessel including an inner opening formed in one of two ends of the inner vessel, an inner lid for opening and closing the inner opening, and an interconnect hole formed in the end of the inner vessel opposite to the inner lid for interconnecting an interior and an exterior of the inner vessel;

said outer vessel including an outer opening formed in an end of the outer vessel on the same side as the inner lid, a pressure-resistant lid for opening and closing the outer opening, a first vent provided at a location corresponding to the interconnect hole of the inner vessel for interconnecting the interior and the exterior of the outer vessel, and a second vent provided in an upper portion of the outer vessel between the first vent and the pressure-resistant lid for interconnecting the interior and the exterior of the outer vessel, and said outer vessel having a shape appropriate for sealing an internal space of the outer vessel with the pressure-resistant lid closed;

wherein a gap is provided between the outer vessel and the inner vessel, the first vent is connected to the suction device and the gap, the first vent is located so that gas produced in the inner vessel as a result of blasting therein is sucked through the first vent and the interconnect hole from the inner vessel and gas produced as a result of blasting and flowing from the interior of the inner vessel through the interconnect hole into the gap is sucked through the first vent, the second vent is connected to the suction device and a portion of the gap that is located between the upper portion of the outer vessel and an upper exterior portion of the inner vessel, and the second vent is located so that gas produced as a result of blasting and released from the inner vessel through the inner opening when the inner lid is opened is sucked through said portion of the gap and the second vent.

2. The blasting treatment apparatus as recited in claim 1, wherein the inner vessel is placed on a bottom portion of the outer vessel in such a manner that the gap between the inner vessel and the outer vessel becomes larger toward an upper side.

3. The blasting treatment apparatus as recited in claim 2, wherein said suction device includes a common suction pump connected to both of the first vent and the second vent, a first regulator for varying a flow rate of the gas sucked from the first vent by the suction pump, and a second regulator for varying the flow rate of the gas sucked from the second vent by the suction pump.

4. The blasting treatment apparatus as recited in claim 1, wherein said suction device includes a common suction pump connected to both of the first vent and the second vent, a first regulator for varying a flow rate of the gas sucked from the first vent by the suction pump, and a second regulator for varying the flow rate of the gas sucked from the second vent by the suction pump.

* * * * *